US008150306B2

(12) United States Patent
Kikuchi

(10) Patent No.: US 8,150,306 B2
(45) **Date of Patent: *Apr. 3, 2012**

(54) FIXING DEVICE FOR IMAGE FORMING APPARATUS

(75) Inventor: Kazuhiko Kikuchi, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/042,610

(22) Filed: Mar. 8, 2011

(65) Prior Publication Data

US 2011/0158713 A1 Jun. 30, 2011

Related U.S. Application Data

(63) Continuation of application No. 11/947,372, filed on Nov. 29, 2007, now Pat. No. 7,925,185.

(60) Provisional application No. 60/867,925, filed on Nov. 30, 2006.

(30) Foreign Application Priority Data

Nov. 7, 2007 (JP) ..... 2007-289791

(51) Int. Cl.
*G03G 15/20* (2006.01)

(52) U.S. Cl. ..... 399/331; 399/329; 399/333; 219/619; 219/672

(58) Field of Classification Search ..... 399/67, 399/69, 122, 320, 328–331, 334, 335, 338, 399/333; 219/216, 244, 619, 635, 672
See application file for complete search history.

(56) References Cited

U.S. PATENT DOCUMENTS

| | | | | |
|---|---|---|---|---|
| 5,839,043 | A | 11/1998 | Okabayashi et al. | |
| 6,591,082 | B2 | 7/2003 | Samei et al. | |
| 6,807,386 | B2 | 10/2004 | Yasui et al. | |
| 6,819,904 | B2 | 11/2004 | Terada et al. | |
| 6,865,366 | B2 * | 3/2005 | Katayanagi et al. | 399/406 |

(Continued)

FOREIGN PATENT DOCUMENTS

| | | |
|---|---|---|
| JP | 2003-345152 | 12/2003 |
| JP | 2004-020776 | 1/2004 |
| JP | 2004-258382 | 9/2004 |

OTHER PUBLICATIONS

U.S. Office Action mailed Apr. 27, 2010 corresponding to U.S. Appl. No. 11/947,372, filed Nov. 29, 2007.

(Continued)

*Primary Examiner* — David Porta
*Assistant Examiner* — Benjamin Schmitt
(74) *Attorney, Agent, or Firm* — Turocy & Watson, LLP

(57) ABSTRACT

A fixing device according to an embodiment of the invention is provided with a center coil and a side coil to induction heat a metal roller which supports a belt. An auxiliary pressurizing member which is adjacent to an opposing roller which supports the belt and presses the belt against a heat roller is provided. The distance from the center position of induction heating of a heat roller to an entrance of a nip is equalized to the distance from the center position of induction heating of the metal roller to the entrance of the nip. The distance from the temperature reading position of the heat roller to the center position of induction heating of the heat roller is equalized to the distance from the temperature reading position of the belt to the center position of induction heating of the metal roller.

16 Claims, 8 Drawing Sheets

U.S. PATENT DOCUMENTS

| | | | | |
|---|---|---|---|---|
| 2003/0198481 | A1 * | 10/2003 | Kikuchi et al. | 399/69 |
| 2004/0136761 | A1 | 7/2004 | Asakura et al. | |
| 2004/0264991 | A1 | 12/2004 | Yoshikawa | |
| 2005/0191097 | A1 | 9/2005 | Yoshida et al. | |

OTHER PUBLICATIONS

U.S. Office Action mailed Aug. 23, 2010 corresponding to U.S. Appl. No. 11/947,372, filed Nov. 29, 2007.

* cited by examiner

FIXING DEVICE FOR IMAGE FORMING APPARATUS

CROSS REFERENCE TO RELATED APPLICATION

This application is a Continuation of application Ser. No. 11/947,372 filed on Nov. 29, 2007, the entire contents of which are incorporated herein by reference.

This invention is based upon and claims the benefit of priority from prior U.S. Patent Application 60/867,925 filed on Nov. 30, 2006, and Japanese Patent Application 2007-289791 filed on Nov. 7, 2007, the entire contents of both of which are incorporated herein by reference.

BACKGROUND OF THE INVENTION

1. Field of the Invention

The present invention relates to a fixing device mounted to image forming apparatuses such as coping machines, printers, facsimile machines and, more specifically, to a fixing device for an image forming apparatus in which an induction heating system is employed.

2. Description of Background

In recent years, there exists a fixing device used for image forming apparatuses such as electrophotographic copying machines and printers, in which an induction heating system is employed. The fixing devices employing the induction heating system as such include a device in which speeding up of the fixing speed is realized by further increasing the warming up speed of the fixing device. For example, an Image Device in which the warming up time is reduced by arranging an exciting coil around a heat-generating roller is disclosed in U.S. Pat. No. 6,819,904.

However, in the device in the related art described above, although the speeding up is realized by heating the heat-generating roller provided on the side which comes into contact with a toner image by the exciting coil, there is no heat source on the side of a pressurizing member. Therefore, when a large amount of heat is consumed continuously as in a case of fixing color images consecutively at a high speed, the amount of heat is not sufficient especially on the side of the pressurizing member, and there is a fear that defective quality of fixing image occurs.

Therefore, in the fixing device in which the speeding up is realized by the induction heating system, the development of a fixing device for an image forming apparatus, in which the shortage of the amount of heat on the side of the pressurizing member is solved so that a high quality fixed image is obtained without defective quality of fixing image even in the case of forming color images consecutively at a high speed, is desired.

SUMMARY OF THE INVENTION

According to an aspect of the invention, when a belt which defines a nip with respect to a heat-generating member is heated by the induction heating system, the belt is pressed against the heat-generating member by a pressing member. Accordingly, there is provided a fixing device for an image forming apparatus which achieves improvement of the image quality by preventing defective quality of fixing image when forming color images consecutively at a high speed.

According to an embodiment of the invention, a fixing device for an image forming apparatus includes a heat-generating member having a metal layer which is to be injection-heated, a first induction current generating device arranged in the proximity to the heat-generating member, a belt opposing the heat-generating member and being rotatably supported by a plurality of rollers for defining a nip with respect to the heat-generating member, a second induction current generating device arranged on the periphery of the belt for heating the belt by the induction heating, and a pressing member for pressing the belt against the heat-generating member at the position of the nip.

DETAILED DESCRIPTION OF THE INVENTION

Figure 1:
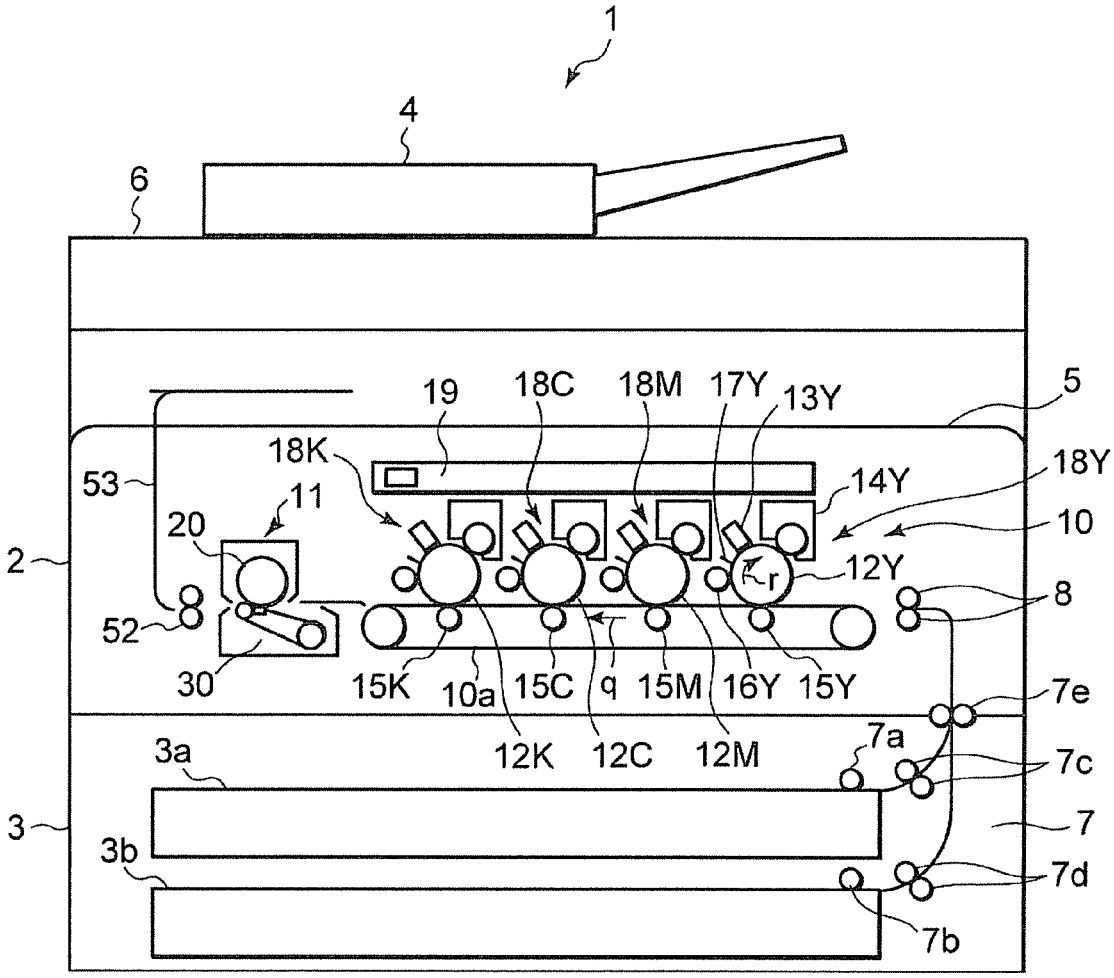
FIG. 1 is a schematic structural view showing an image forming apparatus according to a first embodiment of the invention.

Referring now to the attached drawings as examples, a first embodiment of the invention will be described in detail below. FIG. 1 is a schematic structural view showing an image forming apparatus 1 according to the first embodiment of the invention. The image forming apparatus 1 includes a scanner unit 6 configured to read originals, and a paper feed unit 3 configured to feed a sheet paper P as a recording medium to a printer unit 2 configured to form images. The scanner unit 6 converts image information read from the original supplied by an automatic documentation feeder 4 provided on the upper surface thereof into analogue signals.

The printer unit 2 includes an image forming unit 10 in which image forming stations 18Y, 18M, 18C, and 18K for respective colors of yellow (Y), magenta (M), cyan (C), and black (K) respectively arranged in tandem along a transfer belt 10*a* rotated in the direction indicated by an arrow q. The image forming unit 10 further includes a laser exposure device 19 configured to irradiate a laser beam according to image information to photoconductive drums 12Y, 12M, 12C, and 12K of the image forming stations 18Y, 18M, 18C, and 18K for the respective colors. The printer unit 2 further includes a fixing device 11, a paper discharge roller 52, and a discharged paper carrying path 53 for carrying the sheet paper P after fixation to a paper discharge unit 5.

The image forming station 18Y for yellow (Y) in the image forming unit 10 includes a charger 13Y, a developing device 14Y, a transfer roller 15Y, a cleaner 16Y and a charge-removed unit 17Y arranged around the photoconductive drum 12Y which rotates in the direction indicated by an arrow r. The image forming stations 18M, 18C, and 18K for the respective colors of magenta (M), cyan (C), and black (K) have the same configuration as the image forming station 18Y for yellow (Y).

The paper feed unit 3 includes first and second paper feed cassettes 3*a*, 3*b*. In a carrying path 7 for the sheet paper P extending from the paper feed cassettes 3*a*, 3*b* to the image forming unit 10, pickup rollers 7*a*, 7*b* for taking the sheet paper P from the paper feed cassettes 3*a*, 3*b*, separating and carrying rollers 7*c*, 7*d*, carrying rollers 7*e* and resist rollers 8 are provided.

When printing operation is started, the photoconductive drum 12Y is rotated in the direction indicated by the arrow r and is charged uniformly by the charger 13Y in the image forming station 18Y for yellow (Y) in the printer unit 2. Subsequently, the photoconductive drum 12Y is irradiated with exposure light corresponding to yellow image information read in the scanner unit 6 by the laser exposure device 19, whereby an electrostatic latent image is formed thereon. Then, the photoconductive drum 12Y receives supply of toner by the developing device 14Y, whereby a toner image in yellow (Y) is formed on the photoconductive drum 12Y. The yellow (Y) toner image is transferred to the sheet paper P carried in the direction indicated by the arrow q on the transfer belt 10*a* at the position of the transfer roller 15Y. After having transferred the toner image, remaining toner on the photoconductive drum 12Y is cleaned by the cleaner 16Y, the surface of the photoconductive drum 12Y is removed by the charge-removed unit 17Y, so as to be ready for the next printing operation.

In the image forming stations 18M, 18C, and 18K in respective colors of magenta (M), cyan (C), and black (K), the toner images are formed in the same manner as the yellow (Y) image forming station 18Y. The respective toner images formed in the image forming stations 18M, 18C, and 18K in the respective colors are transferred on the sheet paper P where the yellow toner image is formed in sequence at the positions of the respective transfer rollers 15M, 15C, and 15K. In this manner, the sheet paper P having the color toner images formed thereon is heated and pressurized by the fixing device 11 for fixation, and the printed image is completed thereon. Then, the sheet paper P is discharged to the paper discharge unit 5.

Figure 2:
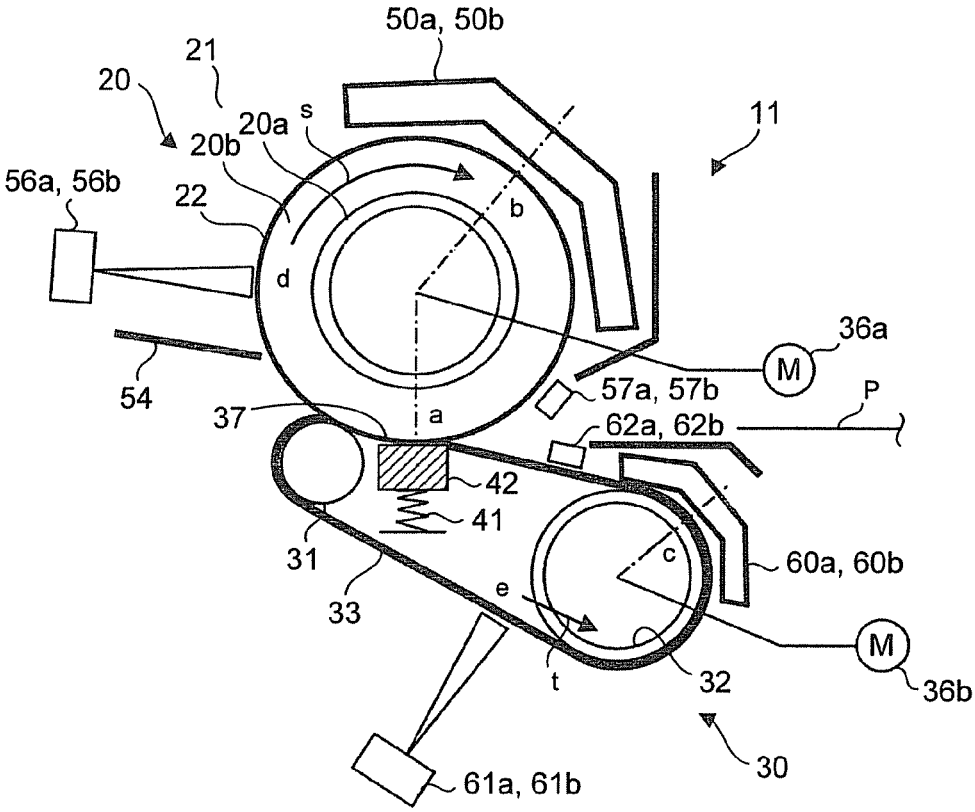
FIG. 2 is a schematic structural view showing a fixing device according to the first embodiment of the invention viewed in the axial direction.

Subsequently, the fixing device 11 will now be described. FIG. 2 is a schematic structural view showing the fixing device 11 viewed in the axial direction. The fixing device 11 is a heat-generating member, and includes a heat roller 20 having an outer diameter of 50 mm. A unitized belt mechanism 30 is arranged at a position opposing the heat roller 20. The belt mechanism 30 includes an endless belt 33 supported by a plurality of rollers, that is, an opposing roller 31 and a metal roller 32. The belt mechanism 30 further includes an auxiliary pressurizing member 42 as a pressing member for elongating the nip width. The auxiliary pressurizing member 42 is pressed by a spring 41, and presses the belt 33 to the heat roller 20. Accordingly, a nip 37 having a prescribed width is formed between the heat roller 20 and the belt 33.

The heat roller 20 is rotated by a first fixing motor 36*a* in the direction indicated by an arrow s. The belt 33 is traveled by the rotation of the metal roller 32 caused by a second fixing motor 36*b* in the direction indicated by an arrow t. The heat roller 20 and the belt 33 nip the sheet paper P at the nip 37, and carry the same in the direction of the paper discharge roller 52. The sheet paper P passes through the nip 37 as such formed between the heat roller 20 and the belt 33 and the toner image on the sheet paper P is heated, pressurized and fixed. A drive mechanism of the heat roller 20 and the belt 33 is not limited and, for example, the heat roller 20 and the belt 33 may be rotated by the same fixing motor.

The heat roller 20 includes an elastic roller 21 and a metal belt 22 as a surface layer. The elastic roller 21 includes a metal shaft 20*a* composed of, for example, iron (Fe) or aluminum and a foamed silicon rubber layer 20*b* as an elastic layer arranged on the periphery thereof. The metal shaft 20*a* may either be solid or hollow. The foamed silicon rubber layer 20*b* has heat resisting properties and heat insulating properties, and is formed, for example, of micro cellular foaming member of continuous foam having an average cell diameter of about 150 μm.

Figure 3:
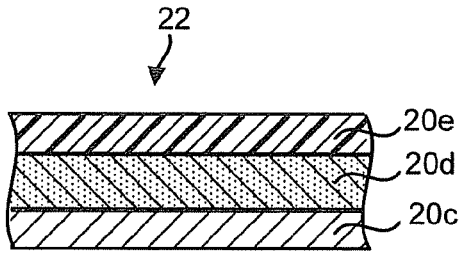
FIG. 3 is a schematic cross-sectional view showing a metal belt of a heat roller according to the first embodiment of the invention.

The metal belt 22 includes a silicon rubber layer 20*d* having a thickness of, for example, 0.1 to 0.5 mm on the surface of a metal conductive layer 20*c* as a metal layer having a thickness of 30 to 50 μm formed, for example, of nickel (Ni) as shown in FIG. 3. The metal belt 22 further includes a release layer 20*e* formed on the surface of the silicon rubber layer 20*d*. The release layer 20*e* is formed of, for example, fluorine contained resin (PFA or PTFE (Polytetrafluoroethylene), or a mixture of PFA and PTFE). The layer thickness of the release layer 20*e* is, for example, 0.05 to 0.2 mm. The metal layer is not limited to nickel, and may be magnetic stainless, iron, and so on. The metal layer may be formed of any material as long as good heating efficiency is demonstrated in the induction heating system.

The foamed silicon rubber layer 20*b* of the elastic roller 21 heat-insulates the metal shaft 20*a* from the metal conductive layer 20*c*. Accordingly, the heat capacity of the entire heat roller 20 is maintained at a lower level. The foamed silicon rubber layer 20*b* is formed to have a thickness of, for example, about 5 to 15 mm in order to keep the nip 37 formed with respect to the belt 33 to be wide and to keep a distance which can prevent the metal shaft 20*a* from being affected by magnetic flux generated from an induction current generating device. If the thickness of the foamed silicon rubber layer 20*b* is too large, a stress on a boundary plane with respect to the metal shaft 20*a* is increased due to torque (load) in association with the rotation of the heat roller 20, which may result in breakage. Therefore, the thickness is preferably about 15 mm or less. The hardness of the foamed silicon rubber layer 20*b* is preferably about ASKER C20 to 40°.

The metal shaft 20*a* and the foamed silicon rubber layer 20*b* of the elastic roller 21 are fixed to each other. The metal conductive layer 20*c* and the silicon rubber layer 20*d* of the metal belt 22, and the silicon rubber layer 20*d* and the release layer 20*e* of the same are also fixed to each other. However, the foamed silicon rubber layer 20*b* and the metal conductive layer 20*c* are not adhered to each other.

When the temperature is a room temperature (25° C.), the elastic roller 21 is smaller in outer diameter than the inner diameter of the metal belt 22 by, for example, about 0.2 to 0.7 mm. Therefore, since the metal belt 22 is not fixed to the elastic roller 21 by adhesion, the metal belt 22 is slidable with respect to the elastic roller 21, and hence it is replaceable when the lifetime of the metal belt 22 is over. The elastic roller 21 is heat-expanded when being heated. For example, when the surface of the heat roller 20 is kept going at 170° C., which is a fixable temperature, the foamed silicon rubber layer 20*b* gradually expands. In this manner, in a state in which the foamed silicon rubber layer 20*b* is expanded, the outer diameter of the elastic roller 21 is larger than the inner diameter of the metal belt 22 by about 0.2 to 0.5 mm, for example. Accordingly, the metal belt 22 is adapted thereby to fit on the elastic roller 21 in a state of fasten the elastic roller 21. The structure of the heat roller 20 is not limited, and may be formed integrally by adhering the foamed silicon rubber layer 20*b* and the metal conductive layer 20*c*.

In the belt mechanism 30, the opposing roller 31 is brought into contact with the heat roller 20. Accordingly, the belt 33 is pressed against and brought into contact with the heat roller at the position of the opposing roller 31. The belt 33 is further pressed against the heat roller 20 by the auxiliary pressurizing member 42. Therefore, the nip 37 of a prescribed width, for example, 14 mm, from the opposing roller 31 to the auxiliary pressurizing member 42 is formed between the heat roller 20 and the belt 33. On the other hand, the metal roller 32 is formed of magnetic stainless. However, the metal roller is not limited thereto, and may be iron, nickel or the like as long as good heating efficiency is demonstrated in the induction heating system.

Figure 4:
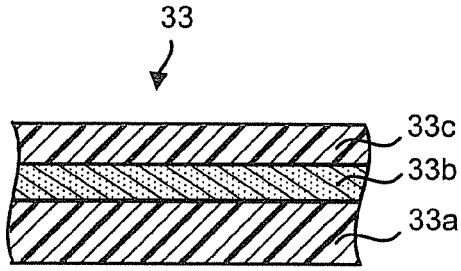
FIG. 4 is a schematic cross-sectional view showing a belt according to the first embodiment of the invention.

The belt 33 is configured, for example, by forming an elastic layer 33*b* formed of heat-resisting rubber such as silicon rubber and a release layer 33*c* formed of fluorine contained resin such as PFA on a base material 33*a* formed of heat-resisting resin such as polyimide resin, as shown in FIG. 4. The thickness of the base material 33*a* is, for example, 0.1 to 0.5 mm. The belt 33 is not limited to resin, but may include metal powder dispersed in the base material. Accordingly, the belt 33 by itself is capable of generating heat by the induction heating.

The auxiliary pressurizing member 42 of the belt mechanism 30 is formed of silicon rubber having a rectangular shape in cross-section, and corners of the rectangle are formed into a rounded R-shape. The auxiliary pressurizing member 42 forms the nip 37 between the heat roller 20 and the belt 33 in cooperation with the opposing roller 31 to widen the width of the nip 37. In this manner, by widening the width of the nip 37, the load of the auxiliary pressurizing member 42 applied to the heat roller 20 when nipping the sheet paper P at the nip 37 for fixing is reduced. In this embodiment, the load of the auxiliary pressurizing member 42 with respect to the heat roller 20 at the time of fixing is, for example 400N.

Provided on the outer periphery of the heat roller 20 are a separating claw 54, first and second induction current generating coils 50*a*, 50*b* as first induction current generating devices, first and second thermistors 56*a*, 56*b* which are heat-generating member temperature sensors and are not in contact with the heat roller 20, and first and second thermostats 57*a*, 57*b*. The separating claw 54 prevents the sheet paper P after fixation from being wrapped around the heat roller 20. The separating claw 54 may either be contact type or non-contact type.

The first and second induction current generating coils 50*a*, 50*b* are provided on the outer periphery of the heat roller 20 via a predetermined gap, and cause the metal conductive layer 20*c* of the heat roller 20 to generate heat. The first induction current generating coil 50*a* causes the center area of the heat roller 20 to generate heat and the second induction current generating coil 50*b* causes an area on both sides of the heat roller 20 to generate heat. Therefore, when carrying out the fixation of the sheet paper P of a small size, for example, electric power is supplied to the first induction current generating coil 50*a* to cause the center area of the heat roller 20 to generate heat, while power supply to the second induction current generating coil 50*b* is turned off.

When causing the whole length of the heat roller 20 to generate heat, outputs of the first and second induction current generating coils 50*a*, 50*b* are switched alternately, and both of them are set to be adjustable from 200 W to 1500 W, for example. The first and second induction current generating coils 50*a*, 50*b* may be capable of outputting simultaneously. When outputting simultaneously, the output values of the first induction current generating coil 50*a* and the second induction current generating coil 50*b* may be differentiated. For example, when there are more sheet papers P passing through the center area of the heat roller 20 than those passing through both sides, the output of the first induction current generating coil 50*a* may be set to a larger value than that of the second induction current generating coil 50*b*.

The first and second induction current generating coils 50*a*, 50*b* are formed by winding wire members around a magnetic core for focusing magnetic flux onto the heat roller 20. The wire members employed here are, for example, Litz wires formed by coating copper wire members with heat-resisting polyamide imide to insulate from each other and binding a plurality of the coated copper wire members together. By employing the Litz wires as the wire members, the diameter of the wire members may be set to be smaller than the depth of penetration of the magnetic field. Accordingly, a high-frequency current can be applied effectively to the wire members. In this embodiment, forty copper wire members having a diameter of 0.3 mm are bound to form the Litz wires.

When a predetermined high-frequency current is supplied to the Litz wires as such, the first and second induction current generating coils 50*a*, 50*b* generate magnetic fluxes. The magnetic fluxes generate an eddy current in the metal conductive layer 20*c* so as to prevent variations in magnetic field. Joule heat is generated by the eddy current and the resistance value of the metal conductive layer 20*c*, so that the heat roller 20 causes to generate heat instantaneously.

For example, thermopile type infrared temperature sensors are used as the first and second thermistors 56*a*, 56*b* which do not in contact with the heat roller 20. The thermopile type infrared temperature sensor receives infrared rays, calculates infrared energy and detects temperature variations at a warm junction generated in the thermopile as an activation power for the thermocouple. The first thermistor 56*a* detects the surface temperature of substantially the center of the heat roller 20 and converts the same into a voltage. The second thermistor 56*b* detests the surface temperature of the side portions of the heat roller 20 and converts the same into a voltage.

The first thermostat 57*a* detects trouble in surface temperature at the center portion of the heat roller 20. The second thermostat 57*b* detects trouble in surface temperature of the side portions of the heat roller 20. When either one of the first and second thermostats 57*a*, 57*b* detects trouble, the power supply to the first and second induction current generating coils 50*a*, 50*b* is forcedly turned OFF.

A center coil 60*a* and a side coil 60*b* are provided as second induction current generating devices on the periphery of the belt 33 at positions opposing the metal roller 32. Third and fourth thermostats 62*a*, 62*b* are provided on the periphery of the belt 33 after having passed through the center coil 60*a* and the side coil 60*b*. Third and fourth thermistors 61*a*, 61*b* composed of thermopile type infrared temperature sensors which are belt temperature sensors and do not come into contact with the belt 33 are provided around the belt 33 after having passed through the nip 37.

The center coil 60*a* causes the widthwise center portion of the metal roller 32 to generate heat and the side coil 60*b* causes the both widthwise side portions of the metal roller 32 to generate heat. Therefore, when carrying out fixation of the sheet paper P of a small size, electric power is supplied to the center coil 60*a* to cause the center portion of the metal roller 32 to generate heat, while power supply to the side coil 60*b* is turned off. In order to cause the whole length of the metal roller 32 to generate heat, the outputs of the center coil 60*a* and the side coil 60*b* are switched alternately, and both of them are set to be adjustable, for example, from 200 W to 1200 W. The center coil 60*a* and the side coil 60*b* may be capable of outputting simultaneously. The center coil 60*a* and the side coil 60*b* are formed simultaneously with the first and second induction current generating coils 50*a*, 50*b*. The metal roller 32 is caused to generate heat instantaneously by the magnetic flux of the center coil 60*a* and the side coil 60*b* and heats the belt 33.

The third thermistor 61*a* detects the surface temperature of the substantially widthwise center of the belt 33 and converts the same into a voltage. The fourth thermistor 61*b* detects the surface temperature of the widthwise side portions of the belt 33 and converts the same to a voltage. The third thermostat 62*a* detects trouble of the surface temperature of the widthwise center portion of the belt 33. The fourth thermostat 62*b* detects trouble of the surface temperature of the widthwise side portions of the belt 33. When the third or fourth thermostat 62*a* or 62*b* detects trouble, power supply to the center coil 60*a* and the side coil 60*b* is forcedly turned OFF.

Subsequently, the layout of the first and second induction current generating coils 50*a*, 50*b* around the heat roller 20, and the center coil 60*a* and the side coil 60*b* around the belt, and the layout of the first and second thermistors 56*a*, 56*b*, and the third and fourth thermistors 61*a*, 61*b* will be described.

It is assumed that the position of the entrance of the nip 37 is "a", the center position of the induction heating by the first and second induction current generating coils 50*a*, 50*b* is "b", and the center position of the induction heating by the center coil 60*a* and the side coil 60*b* is "c". In this case, the first and second induction current generating coils 50*a*, 50*b* and the center coil 60*a* and the side coil 60*b* around the belt are arranged so that the distance between "b" and "a" is the same as the distance between the "c" and "a".

It is further assumed that the reading position on the heat roller 20 by the first and second thermistors 56*a*, 56*b* is "d", and the reading position on the belt 33 by the third and fourth thermistors 61*a*, 61*b* is "e". In this case, the first and second thermistors 56*a*, 56*b* and the third and fourth thermistors 61*a*, 61*b* are arranged so that the distance between "d" and "b" is the same as the distance between "e" and "c".

By equalizing the distance between "b" and "a" and with the distance between "c" and "a", the phase of the control of the first and second induction current generating coils 50*a*, 50*b* can be matched with the phase of the control of the center coil 60*a* and the side coil 60*b* when carrying out a feedback control of the surface temperature of the heat roller 20 and the belt 33. By equalizing the distance between "d" and "b" with the distance between "e" and "c", the phase difference control of the temperature difference between the heat roller 20 side and the belt 33 side caused by heat transfer to the sheet paper P for fixation can be kept constant. Therefore, the phase difference control by a control unit is simplicity.

In particular, when the heat capacities of the heat roller 20 and the belt 33 are small, the temperature ripple caused by the supply of electric power is increased. Therefore, very fine control is required in the feedback control of the temperatures of the heat roller 20 and the belt 33. Therefore, by facilitating the phase difference control by the control unit as described above, the feedback control of the surface temperatures of the heat roller 20 and the belt 33 are prevented from becoming complicated.

When the temperatures of the heat roller 20 and the belt 33 are controlled respectively by the two pieces of the first and second induction current generating coils 50*a*, 50*b* and third and fourth induction current generating coils 61*a*, 61*b* as in this embodiment, the setting control of an inverter drive circuit 72 by a CPU 71 becomes more complicated. Therefore, especially in such a case, speeding up of the setting control of the inverter drive circuit 72 is realized by the facilitation of the control of the phase difference by the CPU 71.

Figure 5:
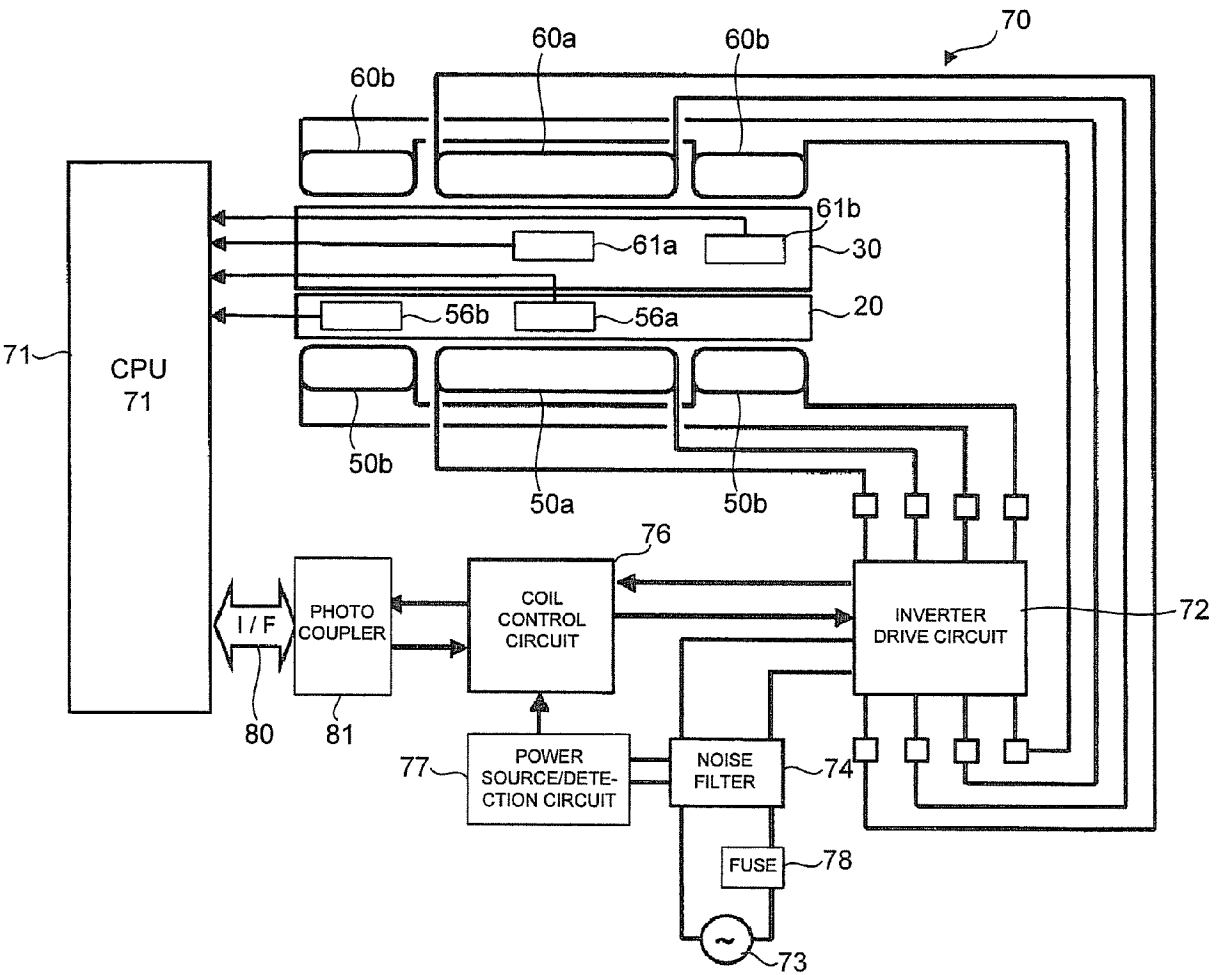
FIG. 5 is a schematic circuit diagram showing a control system according to the first embodiment of the invention.

Referring now to FIG. 5, a control system 70 for carrying out temperature control of the heat roller 20 and the belt 33 will be described. The control system 70 includes the CPU 71, which is a control unit having optional devices such as a document feeder, a finisher, or a facsimile and controlling the entire image forming system on a secondary side. On the other hand, the control system 70 includes the inverter drive circuit 72 for supplying drive power to the first and second induction current generating coils 50*a*, 50*b* and the center coil 60*a* and the side coil 60*b*, a noise filter 74 for rectifying a current from a commercial-use AC power source 73 and supply the same to the inverter drive circuit 72, a coil control circuit 76 for controlling the inverter drive circuit 72, a power source detection circuit 77 for detecting an output from the noise filter 74 and feeding back the same to make the electric power from the commercial-use AC power source 73 constant, and a fuse 78 on a primary side.

An interface 80 of the CPU 71 on the secondary side carries out sending and receiving with respect to the coil control circuit 76 on the primary side via a photo coupler 81. By using the photo coupler 81, the secondary side of the control system 70 can be insulated from the primary side thereof. The results of the temperature detection by the first and second thermistors 56*a*, 56*b* and the third and fourth thermistors 61*a*, 61*b* are entered to the CPU 71.

Figure 6:
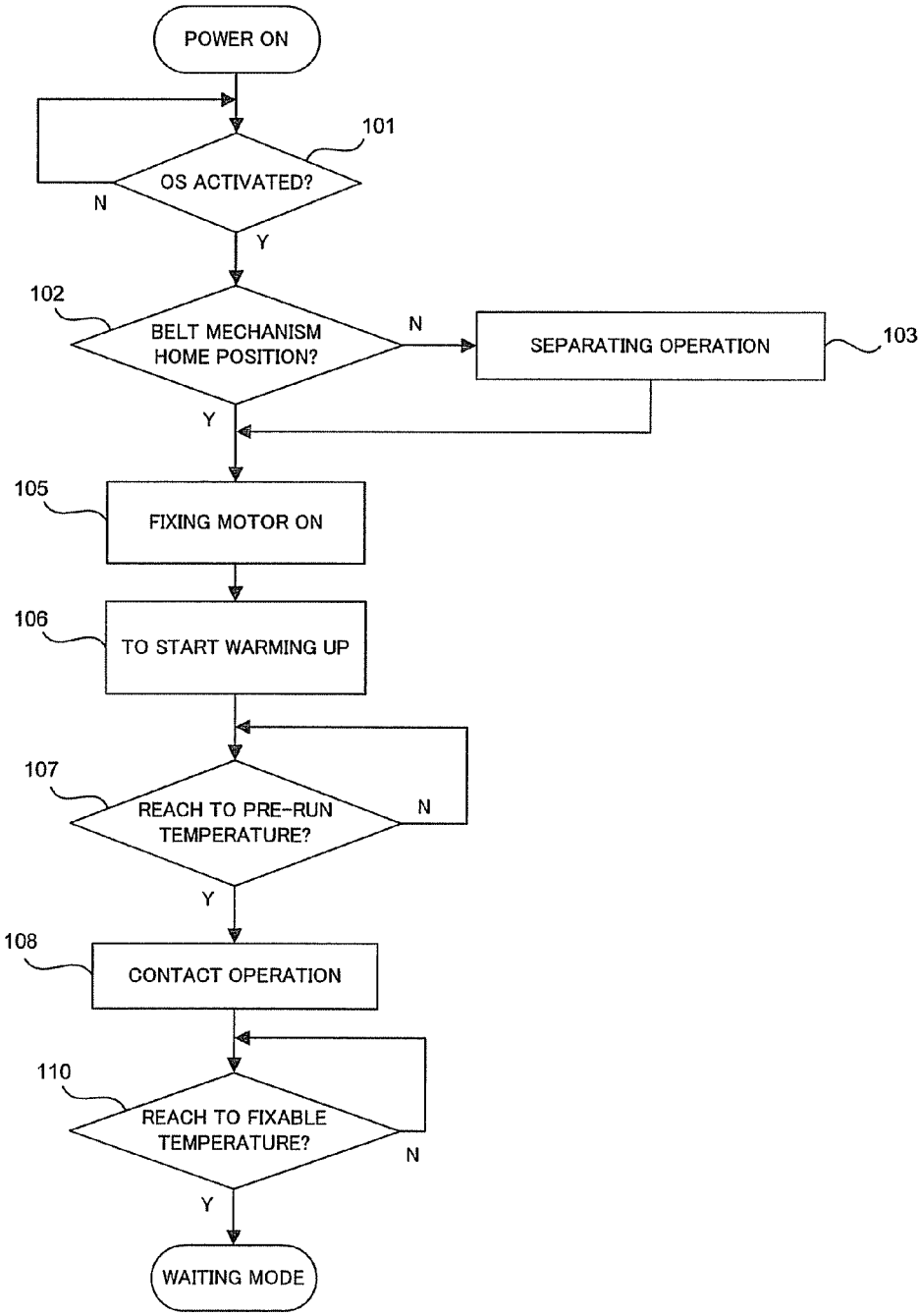
FIG. 6 is a flowchart showing warming up of the heat roller and the belt according to the first embodiment of the invention.

Referring now to a flowchart in FIG. 6, the temperature control of the heat roller 20 and the belt 33 by the control system 70 will be described. While a power source of the image forming apparatus 1 is turned OFF, the belt mechanism 30 is apart from the heat roller 20. When the power source of the image forming apparatus 1 is turned ON in this state, an OS of the CPU 71 is activated for controlling the entire image forming system. Whether or not the OS of the CPU 71 is activated is determined (Step 101), and if yes, whether the belt mechanism 30 is at a home position separate from the heat roller 20 is determined (Step 102). If the belt mechanism 30 is not at the home position, a separating operation for moving the belt mechanism 30 to the home position is carried out (Step 103).

When the belt mechanism 30 is at the home position, the first and second fixing motors 36*a*, 36*b* are turned ON to rotate the heat roller 20 and the belt 33, respectively (Step 105). Then, electric power is supplied to the first and second induction current generating coils 50*a*, 50*b*, the center coil 60*a* and the side coil 60*b* around the belt by the inverter drive circuit 72 to start warming up (Step 106). A total electric power which can be used at this time is fixed. Therefore, the inverter drive circuit 72 distributes the amount of electric power to the first and second induction current generating coils 50*a*, 50*b* and the center coil 60*a* and the side coil 60*b* optimally, in a range of the electric power usable for the temperature control and performs the feedback control.

When the surface temperatures of the heat roller 20 and the belt 33 reach a predetermined pre-run temperature which allow the heat roller 20 to be contacted to the belt mechanism 30 by the result of the temperature detection by the first and second thermistors 56*a*, 56*b* and the third and fourth thermistors 61*a*, 61*b* (Step 107), the heat roller 20 and the belt mechanism 30 are brought into contact with each other (Step 108). At this time, the load of the auxiliary pressurizing member 42 is 400N, and the width of the nip 37 between the heat roller 20 and the belt 33 is 14 mm. Then, the warming up is continued, and whether the surface temperature of the heat roller 20 reaches, for example 170° C., and the surface temperature of the belt 33 reaches, for example, 160° C. is determined (Step 110). When the heat roller 20 and the belt 33 reach the fixable temperature in Step 110, the warming up is completed, and the image forming apparatus 1 is brought into a waiting mode.

During the waiting mode, the surface temperature of the heat roller 20 is detected by the first and second thermistors 56*a*, 56*b* to maintain the temperature thereof at the fixable temperature. In the same manner, the surface temperature of the belt 33 is detected by the third and fourth thermistors 61*a*, 61*b* to maintain the temperature thereof at the fixable temperature. When a print instruction is issued from the CPU 71 after having completed the warming up, the printer unit 2 starts a printing operation, and forms a toner image on the sheet paper Pin the image forming unit 10. Then, the sheet paper P having the toner image is passed through the nip 37 having a width of 14 mm between the heat roller 20 and the belt 33 to heat, pressurize and fix the toner image.

At the time of fixation, the sheet paper P receives fixing energy from the back surface of the sheet paper P as well by the belt 33 which is controlled in temperature by the inverter drive circuit 72. Therefore, nevertheless the heat capacities of the heat roller 20 and the belt 33 are small, the sheet paper P receives sufficient fixing energy through a high-speed continuous fixing operation.

On the other hand, when the sheet papers P of a small size are continuously subjected to the fixation, since the heat capacities of the heat roller 20 and the belt 33 are small, the temperature of the heat roller 20 and the belt 33 is surge on the side portions of the heat roller 20, which are outsides of the paper passing area. Therefore, the waiting time for waiting temperature decrease is required before the heat roller 20 or the belt 33 reaches the limit of heat resistance. However, in this embodiment, since the speed of the setting control of the inverter drive circuit 72 by the CPU 71 is fast, the temperature increase of the heat roller 20 and the belt 33 can be respond in an early stage. Therefore, the waiting time for waiting the temperature decrease of the side portions of the heat roller 20 and the belt 33 may be reduced.

When the print instruction is not issued for a predetermined period after the fixing operation is finished while maintaining the temperatures of the heat roller 20 and the belt 33 at the fixable temperature with the waiting time or the like included and hence it becomes into the waiting mode, the image forming apparatus 1 becomes into a preheating mode.

In the respective modes described above, the CPU 71 always carries out setting control for maintaining the surface temperatures of the heat roller 20 and the belt 33 at the predetermined temperature using the result of detection of temperature from the first and second thermistors 56*a*, 56*b* and the third and fourth thermistors 61*a*, 61*b*. The CPU 71 controls the inverter drive circuit 72 via the coil control circuit 76 on the basis of this setting. In this manner, when carrying out the setting control of the inverter drive circuit 72, the CPU 71 does not have to take care the phase difference due to the difference in position between the first and second induction current generating coils 50*a*, 50*b* and the center coil 60*a* and the side coil 60*b*, and the difference in position between the first and second thermistors 56*a*, 56*b* and the third and fourth thermistors 61*a*, 61*b* of the heat roller 20 and the belt 33 into consideration. Therefore, the setting control of the inverter drive circuit 72 by the CPU 71 is simplicity and hence increase in control speed is realized.

In a case in which the surface temperature of the heat roller 20 exceeds a threshold value due to inability of control of the inverter drive circuit 72 during the feedback control of the surface temperature of the heat roller 20 by the inverter drive circuit 72 in this manner by malfunctioning or the like, the first or second thermostats 57*a*, 57*b* or the third or fourth thermostats 62*a*, 62*b* detects trouble and forcedly turns the inverter drive circuit 72 OFF.

According to the fixing device 11 in the first embodiment, the heat capacity of the heat roller 20 is reduced to realize speeding up of the warming up time. In addition, the belt 33 is heated by induction heating of the metal roller 32 using the center coil 60*a* or the side coil 60*b* to compensate the shortage of the heat capacity of the heat roller 20, during the continuous fixation. Therefore, defective quality of fixing image due to the shortage of the fixing energy during the continuous fixation is prevented, and the waiting time for waiting until the heat roller 20 reaches the fixable temperature maybe shortened, so that the lowering of productivity is prevented.

In addition, with the provision of the auxiliary pressurizing member 42, the width of the nip 37 can be increased. Therefore, the load at the nip 37 between the heat roller 20 and the belt 33 during the fixation is reduced, so that the long lifetime of the heat roller 20 and the belt 33 is realized.

The distances that the heat roller 20 and the belt 33 move from the detecting spot of the surface temperature to the nip spot through heating spot are the same. Therefore, it is not necessary to carry out interpolation control for the phase difference due to displacement of the thermistor and the coil during the setting control of the inverter drive circuit 72 by the CPU 71, so that the setting control of the inverter drive circuit 72 is simplicity. Accordingly, the speeding up of the setting control of the inverter drive circuit 72 by the CPU 71 is realized. Consequently, the setting control of the inverter drive circuit 72 can be carried out in an early stage during the continuous fixation of the sheet papers of a small size, and the waiting time for waiting the lowering of the temperatures of the heat roller 20 and the belt 33 is reduced, so that the reduction of productivity is prevented.

Subsequently, a second embodiment of the invention will be described. The second embodiment is different in control of the heating width of the belt from that in the first embodiment, and other points are the same as the first embodiment. Therefore, in the second embodiment, configurations which are the same as those described in conjunction with the first embodiment described above are represented by the same reference numerals and the detailed description thereof is omitted.

In the second embodiment, the heat generating width of the metal roller 32 of the belt mechanism 30 is not controlled by the two pieces of the center coil and the side coil, but by using a magnetic flux control member 87 provided in the metal roller 32.

Figure 7:
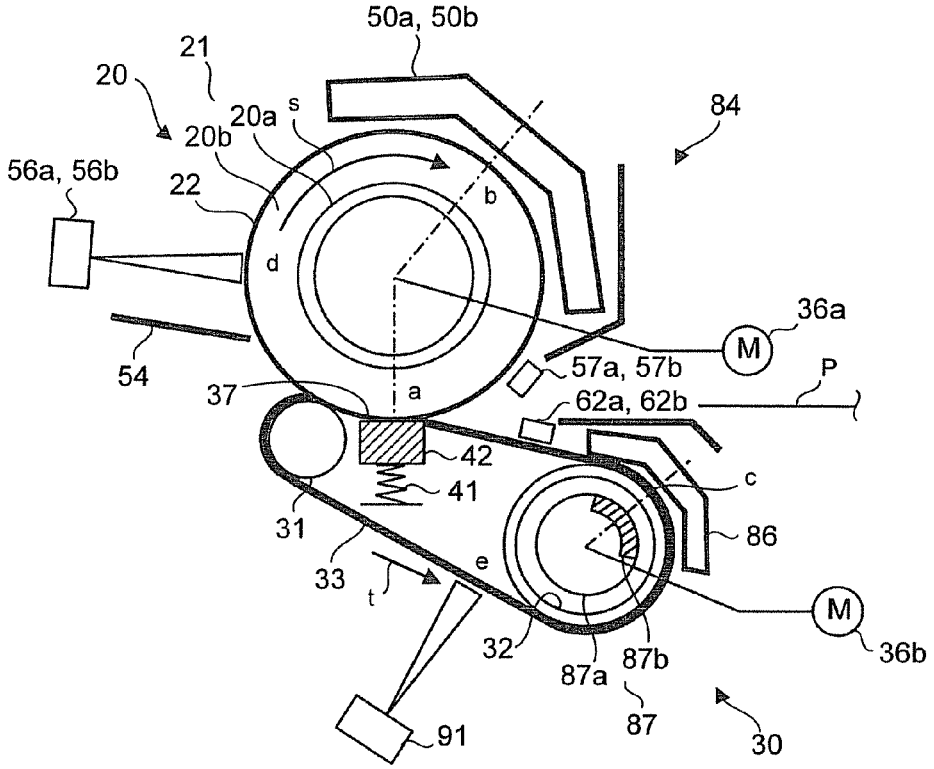
FIG. 7 is a schematic structural view showing a fixing device according to a second embodiment of the invention when viewed in the axial direction.

As shown in FIG. 7, in a fixing device 84 in the second embodiment, a third induction current generating coil 86 as a second induction current generating device is provided at a position on the periphery of the belt 33 at a position opposing the metal roller 32. The third induction current generating coil 86 generates a magnetic flux over the whole length of the metal roller 32. The magnetic flux control member 87 which has a core member 87*b* for controlling the heat generating width of the metal roller 32 is rotatably provided in the hollow interior space of the metal roller 32. The core member 87*b* is formed, for example, so as to match the width of the fixable sheet paper P. The metal roller 32 is caused to generate heat by the magnetic flux control member 87 in an area where the core member 87*b* exists.

Figure 8:
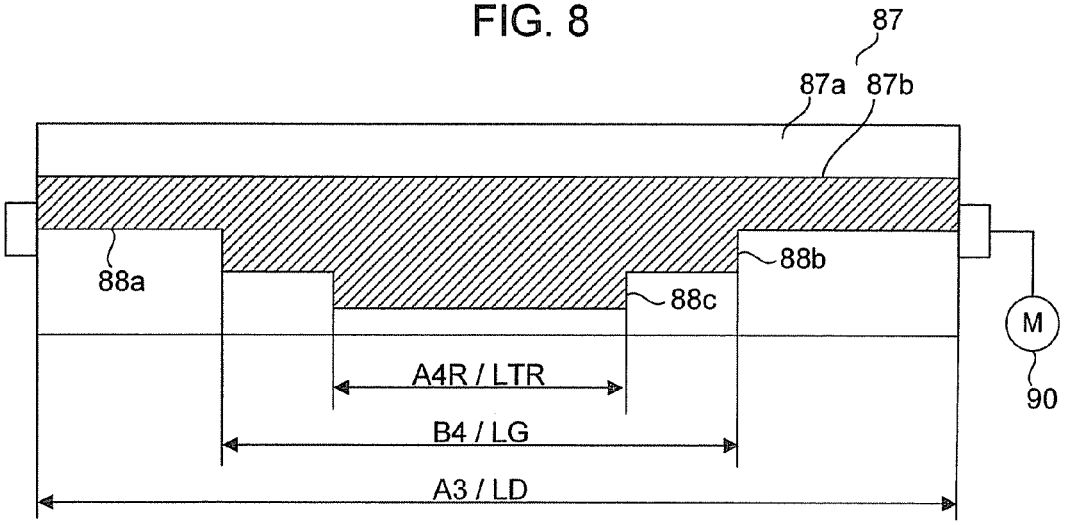
FIG. 8 is a development showing a core member according to the second embodiment of the invention.

The magnetic flux control member 87 includes the core member 87*b* formed of a magnetic material of nickel-zinc alloy (Ni—Zn) provided on the outer peripheral surface of a cylindrical member 87*a* formed of non-magnetic member such as aluminum. The core member 87*b* is formed to have a plurality of widths in a stepped shape as shown in FIG. 8. For example, a first step 88*a* of the core member 87*b* is formed over the whole length of the cylindrical member 87*a* and is formed to have a width which covers A3 size of JIS standard and Ledger (LD) size. A second step 88*b* of the core member 87*b* is formed to have a width which covers B4 size of JIS standard and regal size. A third step 88*c* of the core member 87*b* is formed to have a width which covers A4R size of JIS standard and letter size. The cylindrical member is not limited to aluminum, and may be formed of non-magnetic resin or the like arbitrarily. The material of the core member is also not limited and may be formed of manganese-nickel alloy (Mn—Ni), or the like.

The magnetic flux control member 87 is rotatable by a predetermined angle, for example, by a stepping motor 90. The magnetic flux control member 87 rotates so that the step of the core member 87*b* having a width corresponding to the size of the sheet paper P opposes the third induction current generating coil 86 at the time of fixation. Therefore, when electric power is supplied to the third induction current generating coil 86 at the time of fixation, the metal roller 32 does not generate heat in the area of the cylindrical member 87*a*, and only an area where the core member 87*b* is provided generates heat. In this embodiment, a fifth thermistor 91 for detecting the surface temperature of the substantially widthwise center as a belt temperature sensor for detecting the surface temperature of the belt 33.

Figure 9:
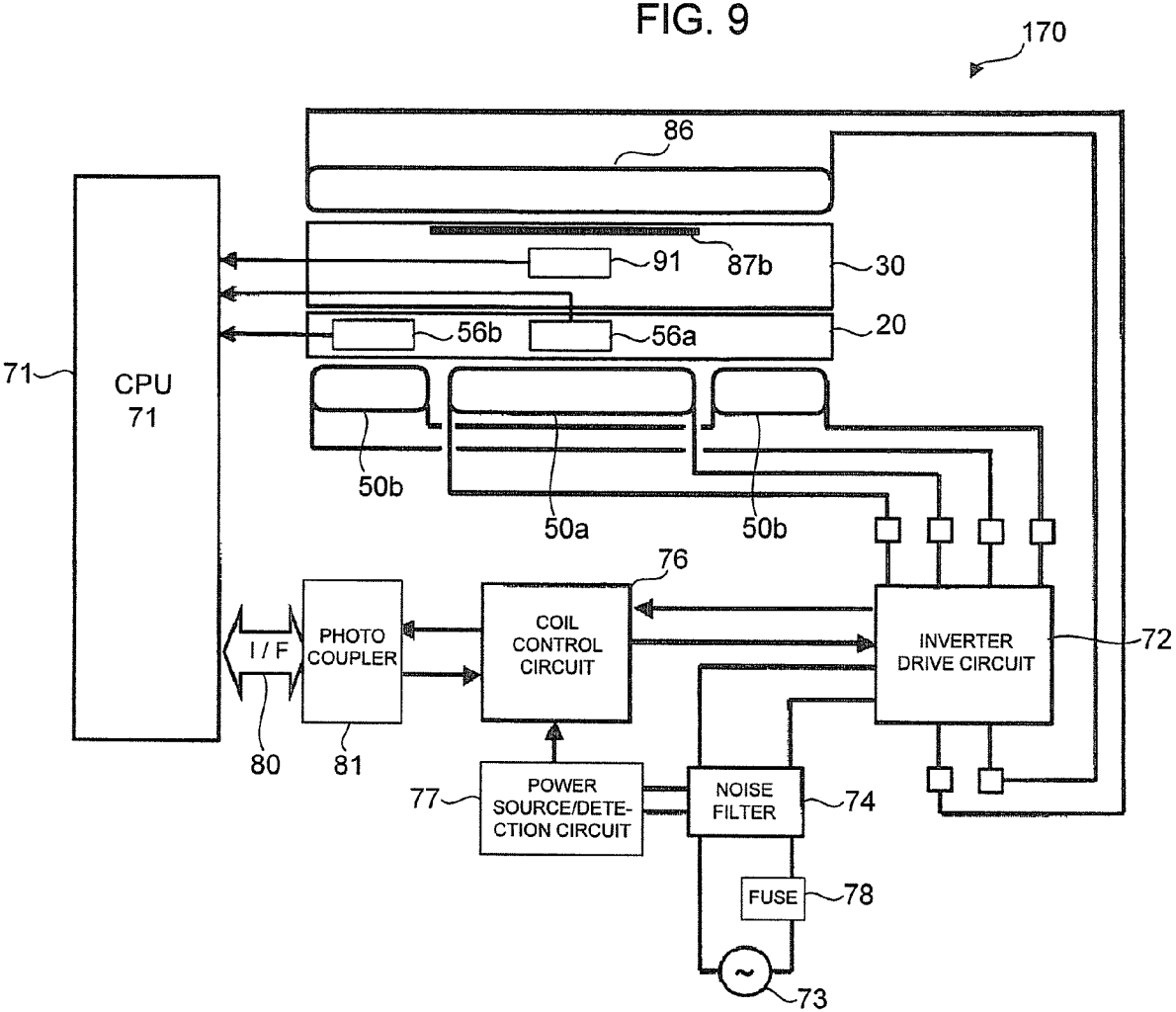
FIG. 9 is a schematic circuit diagram showing a control system according to the second embodiment of the invention.

Subsequently, a control system 170 in this embodiment is shown in FIG. 9. The control system 170 includes the inverter drive circuit 72 for supplying drive power to the first and second induction current generating coils 50*a*, 50*b* and the single third induction current generating coil 86, the noise filter 74 for rectifying a current from the commercial-use AC power source 73 and supply the same to the inverter drive circuit 72, the coil control circuit 76 for controlling the inverter drive circuit 72, the power source detection circuit 77 for detecting an output from the noise filter 74 and feeding back the same to make the electric power from the commercial-use AC power source 73 constant, and the fuse 78 on the primary side. To the CPU 71 on the secondary side, the results of the temperature detection by the first and second thermistors 56*a*, 56*b* and the fifth thermistor 91 is entered. Therefore, the control system 170 in this embodiment is simplified at the temperature control of the belt 33.

Figure 10:
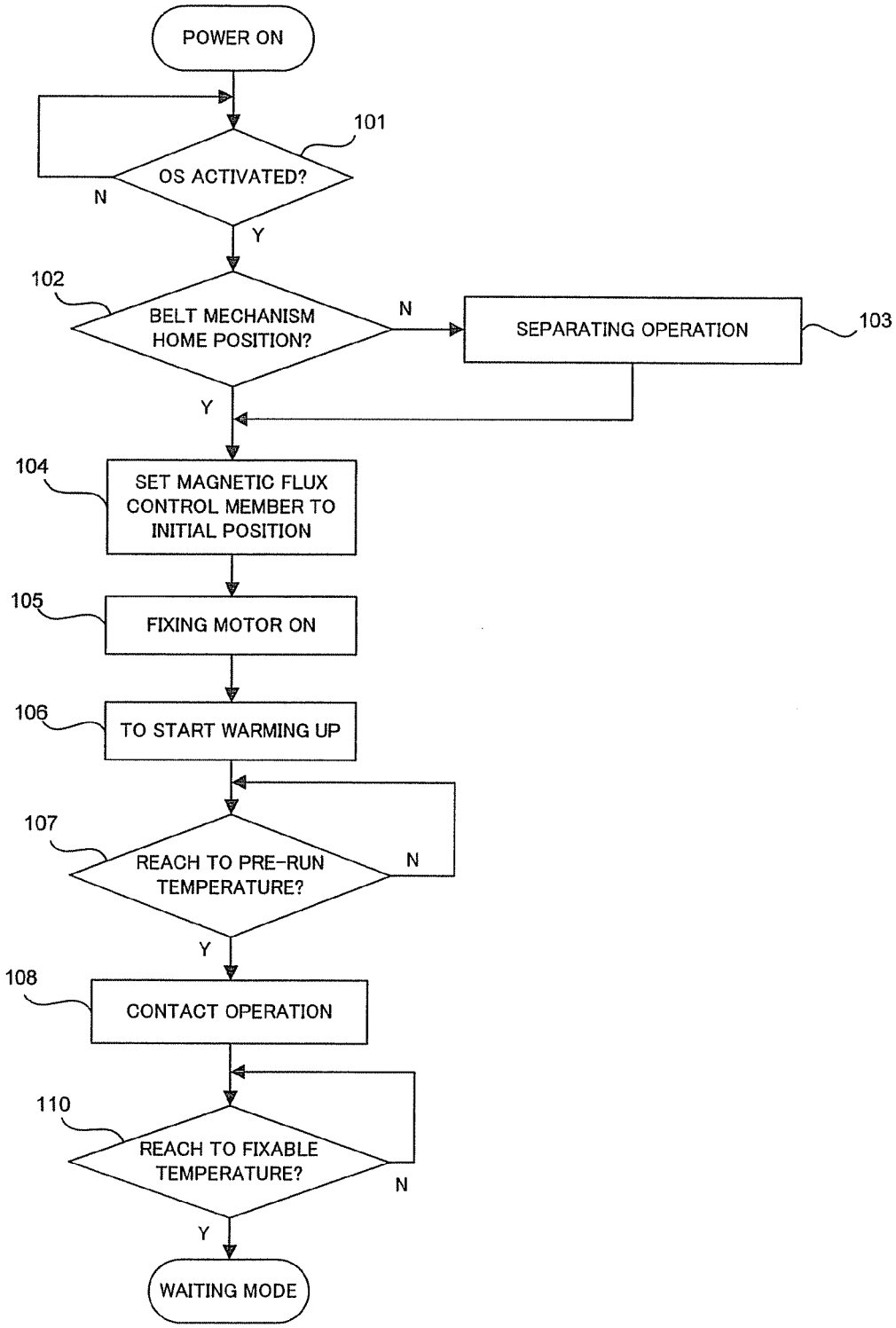
FIG. 10 is a flowchart showing warming up of a heat roller and a belt according to the second embodiment of the invention.

In this embodiment, the temperature control of the heat roller 20 and the belt 33 by the control system 170 is carried out as shown in a flowchart shown in FIG. 10. After having turned the power source of the image forming apparatus 1 ON, procedures in Steps 101 to 103 are performed as in the first embodiment to position the belt mechanism 30 at the home position. Then, the magnetic flux control member 87 rotates so that the first step 88*a* of the core member 87*b* opposes the third induction current generating coil 86 to set the magnetic flux control member 87 to an initial position (Step 104). Then, as in the first embodiment, the warming up is completed through Steps 105 to 108 and 110, so that the image forming apparatus 1 becomes into the waiting mode. In the waiting mode, the belt 33 is heated in the entire area in the widthwise direction to a fixable temperature.

When a print instruction is issued from the CPU 71 after having completed the warming up, the magnetic flux control member 87 rotates according to the size of the sheet paper P to be used on the side of the belt mechanism 30. The step having a width corresponding to the size of the sheet paper P to be used is opposed to the third induction current generating coil 86. Accordingly, the area of the metal roller 32 corresponding to the size of the sheet paper P is caused to generate heat, and heats the belt 33. Subsequently, the toner image formed by the printing operation is heated, pressurized and fixed. In the waiting mode after having finished the fixing operation, the magnetic flux control member 87 is rotated again so that the first step 88*a* of the core member 87*b* opposes the third induction current generating coil 86. Subsequently, when the print instruction is not issued for a predetermined period, the image forming apparatus 1 becomes into a preheating mode (in which the surface temperatures of the heat roller 20 and the belt 33 are respectively maintained at a predetermined preheating temperature which is lower than the fixable temperature, and the surface temperatures of the heat roller 20 and the belt 33 are increased to the printable fixing temperature immediately when the print instruction is issued.).

During this period, the inverter drive circuit 72 only supplies electric power to the single third induction current generating coil 86 according to the result of the temperature detection of the fifth thermistor 91 on the side of the belt mechanism 30.

According to the fixing device 84 in the second embodiment, the speeding up of the warming up time is obtained as in the case of the first embodiment, and lowering of productivity at the time of continuous fixation is prevented. Since the width of the nip 37 is increased by the auxiliary pressurizing member 42, the load applied between the heat roller 20 and the belt 33 at the position of the nip 37 can be reduced, so that the long lifetime of the heat roller 20 and the belt 33 is realized. In addition, it is not necessary to perform the compensation control of the phase difference at the time of setting control of the inverter drive circuit 72 by the CPU 71, and hence the speeding up of the setting control is realized, so that the lowering of productivity is prevented. Furthermore, on the side of the belt mechanism 30, with the provision of the magnetic flux control member 87, the heat generating width of the metal roller 32 is controllable nevertheless the induction heating is carried out by the single third induction current generating coil 86. Therefore, the structure including the circuit and control are simplified in comparison with the coil divided in two pieces which controls the heat generating width, so that the downsizing of the fixing device 84 is realized.

The invention is not limited to the above-described embodiments, and may be modified within the scope of the invention. For example, the shape or the structure of the pressing member is arbitrary. Furthermore, the width of the nip formed by the pressing member and the magnitude of the load are not limited. In order to simplify the compensation of the phase difference at the time of the temperature control, equalizing only one of the distance from the temperature detecting positions to the center positions of the induction heating of the heat-generating member and the belt and the distance from the center positions of induction heating to the nip therebetween is also realized.

Figure 11:
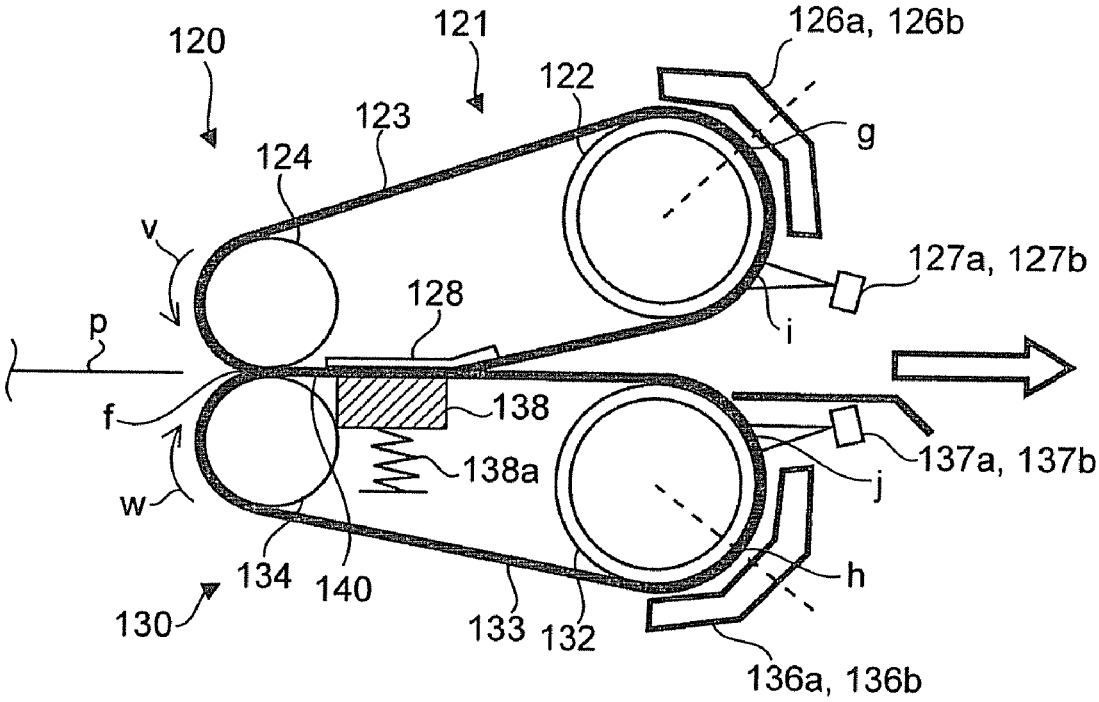
FIG. 11 is a schematic structural view showing a configuration of a fixing device according to a modification of the invention when viewed in the axial direction.

Furthermore, the structure or the like of the fixing device is not limited, and the heat-generating member is not limited to the roller, and may be a belt-shaped member like a fixing device 120 in another modification shown in FIG. 11. In this modification, a second belt mechanism 121 for supporting a second belt 123 rotating in the direction indicated by an arrow v by a second metal roller 122 and a second opposing roller 124 is provided. The metal roller 122 is to be induction-heated by fifth and sixth induction current generating coils 126*a*, 126*b*. The surface temperature of the second belt 123 is detected by fifth and sixth thermistors 127*a*, 127*b*. The fixing device 120 includes a third belt mechanism 130 for supporting a third belt 133 rotated in the direction indicated by an arrow w by a third metal roller 132 and a fourth opposing roller 134 so as to oppose the second belt mechanism 121. The metal roller 132 is to be induction-heated by seventh and eighth induction current generating coils 136*a*, 136*b*. The surface temperature of the third belt 133 is detected by seventh and eighth thermistors 137*a*, 137*b*.

A nip 140 is defined by a plate 128 formed of silicon rubber of the second belt mechanism 121 and a second auxiliary pressurizing member 138 which is formed of silicon rubber of the third belt mechanism 130 and exerts the load by a second pressing spring 138*a*. It is assumed that the position of the entrance of the nip 140 is "f", the center position of the induction heating of the second belt mechanism 121 is "g", the center position of the induction heating of the third belt mechanism 130 is "h", the temperature reading position of the second belt mechanism 121 is "i", and the temperature reading position of the third belt mechanism 130 is "j" in the fixing device 120. In this case, a layout such that the distance between "g" and "f" and the distance between "h" and "f" are the same, and the distance between "i" and "g" and the distance between "j" and "h" are the same is also applicable. In this configuration, the heat generating widths of the metal rollers of both of the second belt mechanism 121 and the third belt mechanism 130 may be controlled by the magnetic flux control member.

What is claimed is:

1. A fixing device comprising:

a first rotate-heat-generating member comprising a metal layer which is to be induction-heated;

a first induction current generating device arranged in proximity to the first rotate-heat-generating member;

a second rotate-heat-generating member comprising a second metal layer which is to be induction-heated, the second rotate-heat-generating member forms a nip with the first rotate-heat-generating member; and a second induction current generating device which is arranged on the periphery of the second rotate-heat-generating member, and is divided into plural coils in an axial direction, and the second induction current generating device heats the second rotate-heat-generating member by induction heating, and the second induction current generating device is arranged at a location a first distance that an outer periphery of the first rotate-heat-generating member moves from a center of induction heating by the first induction current generating device to the nip is equal to a second distance that an outer periphery of the second induction current generating device moves from a center of induction heating of the second induction current generating device to the nip.

2. The fixing device according to claim 1, wherein the plural coils of the second induction current generating device are opposed to a center portion of the second rotate-heat-generating member in an axial direction and to both side portions of the second rotate-heat-generating member in an axial direction.

3. The fixing device according to claim 2, further comprising a first thermistor which detects a surface temperature of the center portion of the second rotate-heat-generating member, and a second thermistor which detects a surface temperature of the side portion of the second rotate-heat-generating member.

4. The fixing device according to claim 1, wherein the second rotate-heat-generating member includes a belt.

5. The fixing device according to claim 4, further comprising a pressing member which is arranged in an interior of the belt and presses the belt against the first rotate-heat-generating member at a position of the nip.

6. The fixing device according to claim 1, further comprising a magnetic flux control member which is arranged in an interior of the second rotate-heat-generating member.

7. The fixing device according to claim 6, wherein the magnetic flux control member includes plural widths in an axial direction of the second rotate-heat-generating member.

8. The fixing device according to claim 6, wherein a width of the magnetic flux control member which is arranged at the center portion of the second rotate-heat-generating member is widest.

9. An image forming apparatus comprising:

a photoconductor on which is formed a latent image;

a developing device which forms a toner image on the photoconductor;

a transfer device which transfers the toner image to a sheet;

a first rotate-heat-generating member comprising a metal layer which is to be induction-heated;

a first induction current generating device arranged in proximity to the first rotate-heat-generating member;

a second rotate-heat-generating member comprising a second metal layer which is to be induction-heated, the second rotate-heat-generating member forms a nip with the first rotate-heat-generating member, the nip is formed between the first rotate-heat-generating member and the second rotate-heat-generating member and passes the sheet; and a second induction current generating device which is arranged on the periphery of the second rotate-heat-generating member, and is divided into plural coils in an axial direction, and the second induction current generating device heats the second rotate-heat-generating member by induction heating, and the second induction current generating device is arranged at a location a first distance that an outer periphery of the first rotate-heat-generating member moves from a center of induction heating by the first induction current generating device to the nip is equal to a second distance that an outer periphery of the second induction current generating device moves from a center of induction heating of the second induction current generating device to the nip.

10. The image forming apparatus according to claim 9, wherein the plural coils of the second induction current generating device are opposed to a center portion of the second rotate-heat-generating member in an axial direction and to both side portions of the second rotate-heat-generating member in an axial direction.

11. The image forming apparatus according to claim 10, further comprising a first thermistor which detects a surface temperature of the center portion of the second rotate-heat-generating member, and a second thermistor which detects a surface temperature of the side portion of the second rotate-heat-generating member.

12. The image forming apparatus according to claim 11, further comprising a controller which controls a power supply to the second induction current generating device according to a temperature from the first thermistor and the second thermistor.

13. The image forming apparatus according to claim 11, further comprising a conveying guide between the transfer device and the nip.

14. The image forming apparatus according to claim 13, the second induction current generating device is arranged between the conveying guide and the second rotate-heat-generating member.

15. The image forming apparatus according to claim 9, wherein the toner image is fixed in a state that the toner image faces to the first rotate-heat-generating member.

16. The image forming apparatus according to claim 9, wherein a fixable temperature of the first rotate-heat-generating member is higher than a fixable temperature of the second rotate-heat-generating member.

* * * * *